US012215568B2

(12) United States Patent
Malki et al.

(10) Patent No.: US 12,215,568 B2
(45) Date of Patent: Feb. 4, 2025

(54) REMOVAL AND COLLECTION OF WELLBORE SCALE AND DEBRIS

(71) Applicant: Saudi Arabian Oil Company, Dhahran (SA)

(72) Inventors: Bandar S. Malki, Dammam (SA); Juan Manuel Polo Terán, Dhahran (SA); Mohammad Abdullah Alkhateeb, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 57 days.

(21) Appl. No.: 18/077,920

(22) Filed: Dec. 8, 2022

(65) Prior Publication Data

US 2024/0191601 A1 Jun. 13, 2024

(51) Int. Cl.
*E21B 37/02* (2006.01)
*E21B 27/00* (2006.01)

(52) U.S. Cl.
CPC ..... *E21B 37/02* (2013.01); *E21B 27/00* (2013.01)

(58) Field of Classification Search
CPC ..... E21B 37/02; E21B 27/00
See application file for complete search history.

(56) References Cited

U.S. PATENT DOCUMENTS 6,745,839 B1 * 6/2004 Simpson ..... E21B 37/04 166/173
6,951,251 B2 * 10/2005 Penisson ..... E21B 31/08 166/99
8,136,587 B2 3/2012 Lynde et al.
9,062,507 B2 6/2015 Knobloch, Jr. et al.
2007/0131426 A1 * 6/2007 Telfer ..... E21B 27/00 166/99
2015/0337630 A1 11/2015 Cioanta et al.
2019/0048675 A1 2/2019 Alley et al.

OTHER PUBLICATIONS

Haugen et al., "Electric-Line Deployed Lightweight Intervention Technology for the Effective Removal of Barium Sulphate Scale Obstructions from Small Diameter Wellbores," SPE-184758-MS, Society of Petroleum Engineers, 2017, 15 pages.
Kleppan et al., "Removing Settled Barites From a Wellbore Using an Electrically Powered Well Cleanout System," SPE-179102-MS, Society of Petroleum Engineers, 2016, 14 pages.

* cited by examiner

*Primary Examiner* — D. Andrews
(74) *Attorney, Agent, or Firm* — Fish & Richardson P.C.

(57) ABSTRACT

An apparatus includes a scale removal head, a scale collector, a circulating plate assembly, and a guide. The scale removal head includes a plurality of blades that scrape against a wall of a wellbore to remove scale from the wall of the wellbore in response to rotation of the apparatus. The scale collector defines a first inner region within a surrounding slotted chamber. The circulating plate assembly defines a second inner region within a pipe. The first inner region and the second inner region together define a collection volume for accumulating and storing scale that has been removed from the wall of the wellbore. The guide includes a plurality of blades that scrape against the wall of the wellbore to remove scale from the wall of the wellbore as the apparatus rotates.

20 Claims, 8 Drawing Sheets

400

REMOVAL AND COLLECTION OF WELLBORE SCALE AND DEBRIS

TECHNICAL FIELD

This disclosure relates to managing wellbore scale and debris.

BACKGROUND

During hydrocarbon extraction, well fluid flowing from the hydrocarbon reservoir to the surface can include debris such as sand, foreign materials from previous well operations, small pieces of metallic or plastic material, or coating materials from sections of a well completion. If left unhandled, debris—especially large, hard, or sharp—edged debris-carried by the well fluid can cause erosion wear as the debris travels through or past well equipment. In some cases, scale can form on the walls of tubulars and/or downhole equipment installed in wells. The debris and scale can also plug or damage well equipment, which can potentially cause a catastrophic failure of a piece of equipment, such as an electric submersible pump, as it pumps well fluid uphole. Equipment failure can negatively impact production and can increase field asset operating costs. Taking measures to preserve and extend the life of well equipment is favorable to keep production economical.

SUMMARY

This disclosure describes technologies relating to removal and collection of wellbore scale and debris. Certain aspects of the subject matter described can be implemented as an apparatus. The apparatus includes a scale removal head, a scale collector, a circulating plate assembly, and a guide. The scale removal head is configured to couple to a drill pipe and to cause the apparatus to rotate with the drill pipe. The scale removal head includes a first plurality of blades distributed around and extending radially outward from a surface of the scale removal head. Each blade of the first plurality of blades includes a plurality of first inserts disposed on a surface of the respective blade. The first plurality of blades and their respective pluralities of first inserts are cooperatively configured to scrape against a wall of a wellbore to remove scale from the wall of the wellbore in response to rotation of the apparatus. The scale collector is configured to couple to the scale removal head. The scale collector includes a surrounding slotted chamber. The scale collector defines a first inner region within the surrounding slotted chamber. The circulating plate assembly is configured to couple to the scale collector. The circulating plate assembly includes a pipe. The pipe includes an open end and a perforated end that is opposite the open end. The circulating plate assembly defines a second inner region within the pipe. The first inner region and the second inner region together define a collection volume for accumulating and storing scale that has been removed from the wall of the wellbore. The guide is configured to couple to the circulating plate assembly. The guide includes a second plurality of blades distributed around and extending radially outward from a surface of the guide. Each blade of the second plurality of blades includes a plurality of second inserts disposed on a surface of the respective blade. The second plurality of blades and their respective pluralities of second inserts are cooperatively configured to scrape against the wall of the wellbore to remove scale from the wall of the wellbore as the apparatus rotates.

This, and other aspects, can include one or more of the following features. The guide can include a jet nozzle. The jet nozzle can be configured to circulate fluid through the wellbore, thereby facilitating travel of the apparatus through the wellbore and removal of scale from the wall of the wellbore. The scale removal head can be coupled to the drill pipe. The scale collector can be coupled to the scale removal head opposite of the drill pipe. The circulating plate assembly can be coupled to the scale collector opposite of the scale removal head. The guide can be coupled to the circulating plate assembly opposite of the scale collector. The guide can include a body around which the second plurality of blades are distributed and from which the second plurality of blades extend radially outward. The blades of the second plurality of blades of the guide can be smaller in comparison to the blades of the first plurality of blades of the scale removal head. The guide can be configured to, in response to the jet nozzle circulating fluid through the wellbore and the apparatus rotating, centralize the apparatus with respect to the wall of the wellbore. The surrounding slotted chamber of the scale collector can be coupled to the pipe of the circulating plate assembly, such that the surrounding slotted chamber and the pipe form an enclosure having the collection volume for accumulating and storing scale that has been removed from the wall of the wellbore. The scale removal head can be coupled to the drill pipe by a first threaded connection. The scale collector can be coupled to the scale removal head by a second threaded connection. The circulating plate assembly can be coupled to the scale collector by a third threaded connection. The guide can be coupled to the circulating plate assembly by a fourth threaded connection. The surrounding slotted chamber can define a plurality of slots. Each slot of the plurality of slots can have a width in a range of from about 2 millimeters to about 5 millimeters. The perforated end of the pipe of the circulating plate assembly can define a plurality of perforations. Each perforation of the plurality of perforations can have a diameter in a range of from about 2 millimeters to about 5 millimeters.

Certain aspects of the subject matter described can be implemented as a method. An apparatus disposed within a tubular installed in a wellbore is rotated. The apparatus includes a scale removal head, a scale collector, a circulating plate assembly, and a guide. A jet nozzle of the guide circulates fluid through the wellbore, thereby facilitating travel of the apparatus through the tubular. In response to rotating the apparatus and circulating fluid, the apparatus is centralized within the tubular. In response to rotating the apparatus, a first plurality of blades of the scale removal head scrape against a wall of the tubular to remove scale from the wall of the tubular. The first plurality of blades are distributed around and extend radially outward from a surface of the scale removal head. In response to rotating the apparatus, a second plurality of blades of the guide scrape against the wall of the tubular to remove scale from the wall of the tubular. The second plurality of blades are distributed around and extend radially from a surface of the guide. The scale that has been removed from the wall of the tubular is collected within a collection volume of the apparatus. The collection volume is cooperatively defined by a slotted chamber of the scale collector that is coupled to a pipe of the circulating plate assembly.

This, and other aspects, can include one or more of the following features. The scale removal head and the guide can be located at opposite ends of the apparatus. Each blade of the first plurality of blades can include a plurality of first inserts disposed on a surface of the respective blade. The first plurality of blades and their respective pluralities of first inserts can scrape, in response to rotating the apparatus, against the wall of the tubular to remove scale from the wall of the tubular. Each blade of the second plurality of blades can include a plurality of second inserts disposed on a surface of the respective blade. The second plurality of blades and their respective pluralities of second inserts can scrape, in response to rotating the apparatus, against the wall of the tubular to remove scale from the wall of the tubular. The scale collector can include a surrounding slotted chamber. The scale collector can define a first inner region within the surrounding slotted chamber. The circulating plate assembly can include a pipe. The pipe can include an open end and a perforated end that is opposite the open end. The circulating plate assembly can define a second inner region within the pipe. The surrounding slotted chamber of the scale collector can be coupled to the pipe of the circulating plate assembly. The first inner region and the second inner region together can define the collection volume for accumulating and storing scale that has been removed from the wall of the wellbore. The apparatus can be coupled to and rotated by a thru-tubing motor. The apparatus can be coupled to and rotated by a drill pipe. The scale removal head can be coupled to the drill pipe by a first threaded connection. The scale collector can be coupled to the scale removal head opposite of the drill pipe by a second threaded connection. The circulating plate assembly can be coupled to the scale collector opposite of the scale removal head by a third threaded connection. The guide can be coupled to the circulating plate assembly opposite of the scale collector by a fourth threaded connection. The surrounding slotted chamber can define a plurality of slots. Each slot of the plurality of slots can have a width in a range of from about 2 millimeters to about 5 millimeters. The perforated end of the pipe of the circulating plate assembly can define a plurality of perforations. Each perforation of the plurality of perforations can have a diameter in a range of from about 2 millimeters to about 5 millimeters.

Certain aspects of the subject matter described can be implemented as a system. The system includes a coiled tubing, a thru-tubing motor, and an apparatus. The thru-tubing motor is coupled to the coiled tubing. The apparatus is coupled to the thru-tubing motor and disposed within a wellbore. The apparatus includes a scale removal head, a scale collector, a circulating plate assembly, and a guide. The scale removal head is coupled to the thru-tubing motor. The thru-tubing motor is configured to rotate the apparatus. The scale removal head includes a first plurality of blades distributed around and extending radially outward from a surface of the scale removal head. Each blade of the first plurality of blades includes a plurality of first inserts disposed on a surface of the respective blade. The first plurality of blades and their respective pluralities of first inserts are cooperatively configured to scrape against a wall of a wellbore to remove scale from the wall of the wellbore in response to rotation of the apparatus. The scale collector is coupled to the scale removal head opposite of the thru-tubing motor. The scale collector includes a surrounding slotted chamber. The scale collector defines a first inner region within the surrounding slotted chamber. The circulating plate assembly is coupled to the scale collector opposite of the scale removal head. The circulating plate assembly includes a pipe. The pipe includes an open end and a perforated end that is opposite the open end. The circulating plate assembly defines a second inner region within the pipe. The first inner region and the second inner region together define a collection volume for accumulating and storing scale that has been removed from the wall of the wellbore. The guide is coupled to the circulating plate assembly opposite of the scale collector. The guide includes a second plurality of blades distributed around and extending radially outward from a surface of the guide. Each blade of the second plurality of blades includes a plurality of second inserts disposed on a surface of the respective blade. The second plurality of blades and their respective pluralities of second inserts are cooperatively configured to scrape against the wall of the wellbore to remove scale from the wall of the wellbore as the apparatus rotates.

This, and other aspects, can include one or more of the following features. The guide can include a jet nozzle. The jet nozzle can be configured to circulate fluid through the wellbore, thereby facilitating travel of the apparatus through the wellbore and removal of scale from the wall of the wellbore. The guide can include a body around which the second plurality of blades are distributed and from which the second plurality of blades extend radially outward. The blades of the second plurality of blades of the guide can be smaller in comparison to the blades of the first plurality of blades of the scale removal head. The guide can be configured to, in response to the jet nozzle circulating fluid through the wellbore and the apparatus rotating, centralize the apparatus with respect to the wall of the wellbore. The surrounding slotted chamber of the scale collector can be coupled to the pipe of the circulating plate assembly, such that the surrounding slotted chamber and the pipe form an enclosure having the collection volume for accumulating and storing scale that has been removed from the wall of the wellbore. The scale removal head can be coupled to the drill pipe by a first threaded connection. The scale collector can be coupled to the scale removal head by a second threaded connection. The circulating plate assembly can be coupled to the scale collector by a third threaded connection. The guide can be coupled to the circulating plate assembly by a fourth threaded connection. The surrounding slotted chamber can define a plurality of slots. Each slot of the plurality of slots can have a width in a range of from about 2 millimeters to about 5 millimeters. The perforated end of the pipe of the circulating plate assembly can define a plurality of perforations. Each perforation of the plurality of perforations can have a diameter in a range of from about 2 millimeters to about 5 millimeters.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes an integrated wellbore scale remover and collector. The apparatus can be used to remove accumulated scale and debris from a tubing, liner, or casing installed in a well and collect the scale and debris in single runs or multi-trips. The apparatus can be deployed via slickline, coiled tubing, or drill pipe. The apparatus includes a rotating bit, a collection housing, a circulating plate assembly, and a guide. The apparatus can optionally include additional collection housings depending on the severity of scaling in the well. The rotating bit includes a plurality of blades, and each blade includes inserts that facilitate removal of scale/debris from an inner wall of a tubing as the bit rotates. The guide also includes a plurality of blades, and each blade includes inserts that facilitate removal of scale/debris from an inner wall of the tubing as the guide rotates. The collection housing and the circulating plate assembly define a volume available for accumulating scale/debris that has been removed from the inner wall of the tubing.

The subject matter described in this disclosure can be implemented in particular implementations, so as to realize one or more of the following advantages. The apparatuses, systems, and methods described here can be implemented to remove and collect scale and/or debris that has accumulated on the walls of tubulars (such as casing) installed in a wellbore. The apparatus can remove scale from a range of tubular sizes. The apparatuses, systems, and methods described here can maintain well integrity and may lengthen production lifetime of the well. The apparatus can be modularized, such that any of the components can be duplicated based on the characteristics of the well and target objectives for scale/debris removal. The apparatus can be coupled to and driven by a drill pipe or a thru-tubing motor for removal of scale/debris from especially small diameter tubulars. The apparatus can be quickly deployed in a single run or re-used in multiple trips for scale/debris removal and collection. The apparatuses, systems, and methods described here can remove and collect scale and/or debris from a wellbore without requiring mobilization of a workover rig. The apparatuses, systems, and methods described can be implemented to increase well productivity by maintaining a clear production path by removing scale and/or debris during a well lifecycle. The apparatuses, systems, and methods described can be implemented to reduce operational costs for maintaining well integrity.

Figure 1:
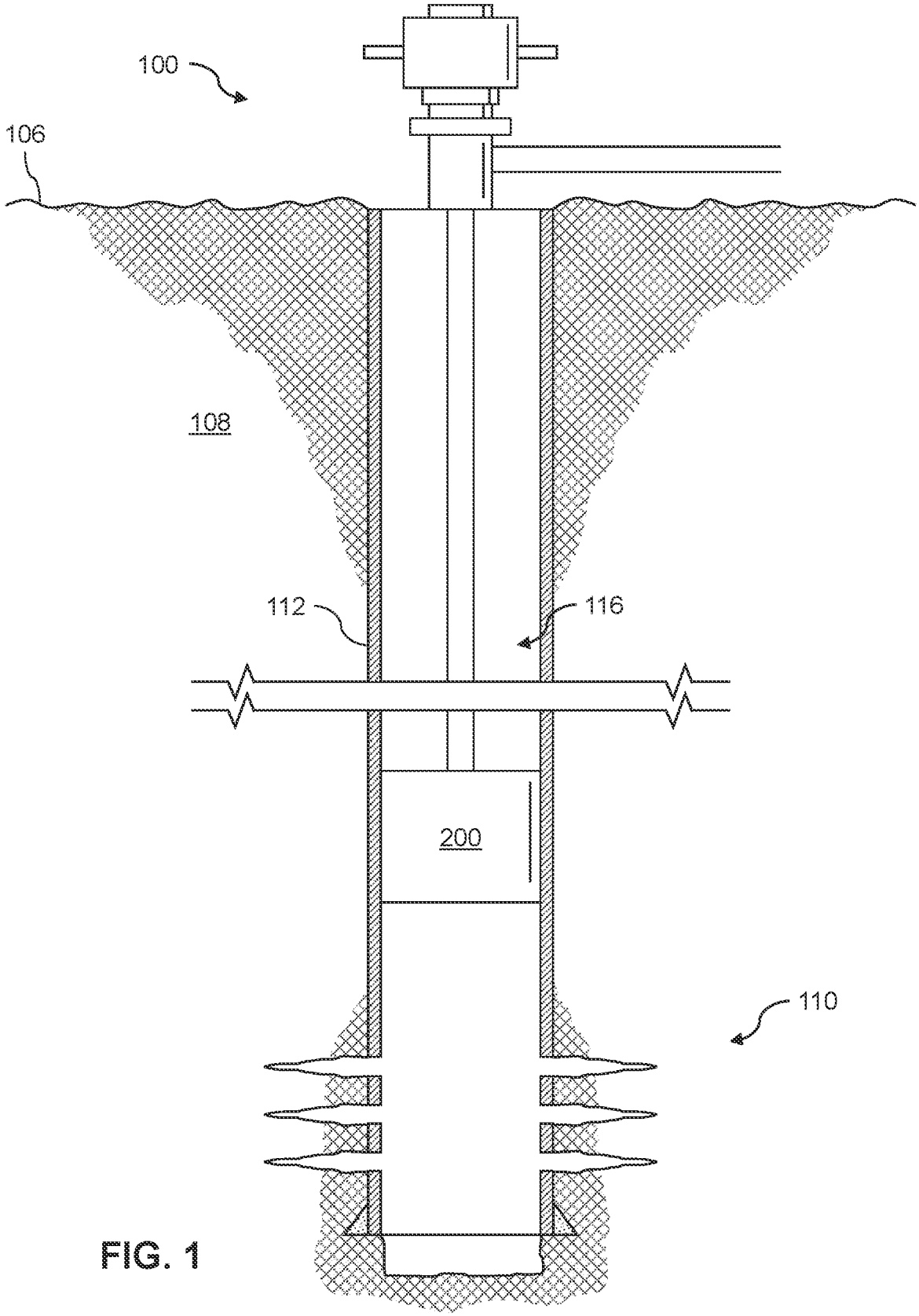
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellhead defines an attachment point for other equipment to be attached to the well 100. For example, FIG. 1 shows well 100 being produced with a Christmas tree attached to the wellhead. The Christmas tree includes valves used to regulate flow into or out of the well 100. The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly) end-to-end. In FIG. 1, the casing 112 is perforated in the subterranean zone of interest 110 to allow fluid communication between the subterranean zone of interest 110 and the bore 116 of the casing 112. In particular, casing 112 is commercially produced in a number of common sizes specified by the American Petroleum Institute (the "API"), including 4½, 5, 5½, 6, 6⅝, 7, 7⅝, 7¾, 8⅝, 8¾, 9⅝, 9¾, 9⅞, 10¾, 11¾, 11⅞, 13⅜, 13½, 13⅝, 16, 18⅝, and 20 inches, and the API specifies internal diameters for each casing size. The apparatus 200 can be configured to fit in, and (as discussed in more detail below) in certain instances, scrape against the inner diameter of one of the specified API casing sizes. Of course, the apparatus 200 can be made to fit in and, in certain instances, scrape against other sizes of casing or tubing or otherwise scrape a wall of the well 100. In some implementations, the casing 112 is omitted or ceases in the region of the subterranean zone of interest 110. This portion of the well 100 without casing is often referred to as "open hole."

In some cases, scale and/or debris accumulate in the well 100, for example, on the wall(s) of tubulars disposed in the wellbore. An apparatus 200 can be deployed in the well 100 to remove and collect such scale and/or debris. For example, the apparatus 200 can scrape against one or more walls of the wellbore and store the scale and/or debris that has been removed from the one or more walls of the wellbore. An example of the apparatus 200 is shown in FIG. 2A and is described in more detail later.

Figure 2A:
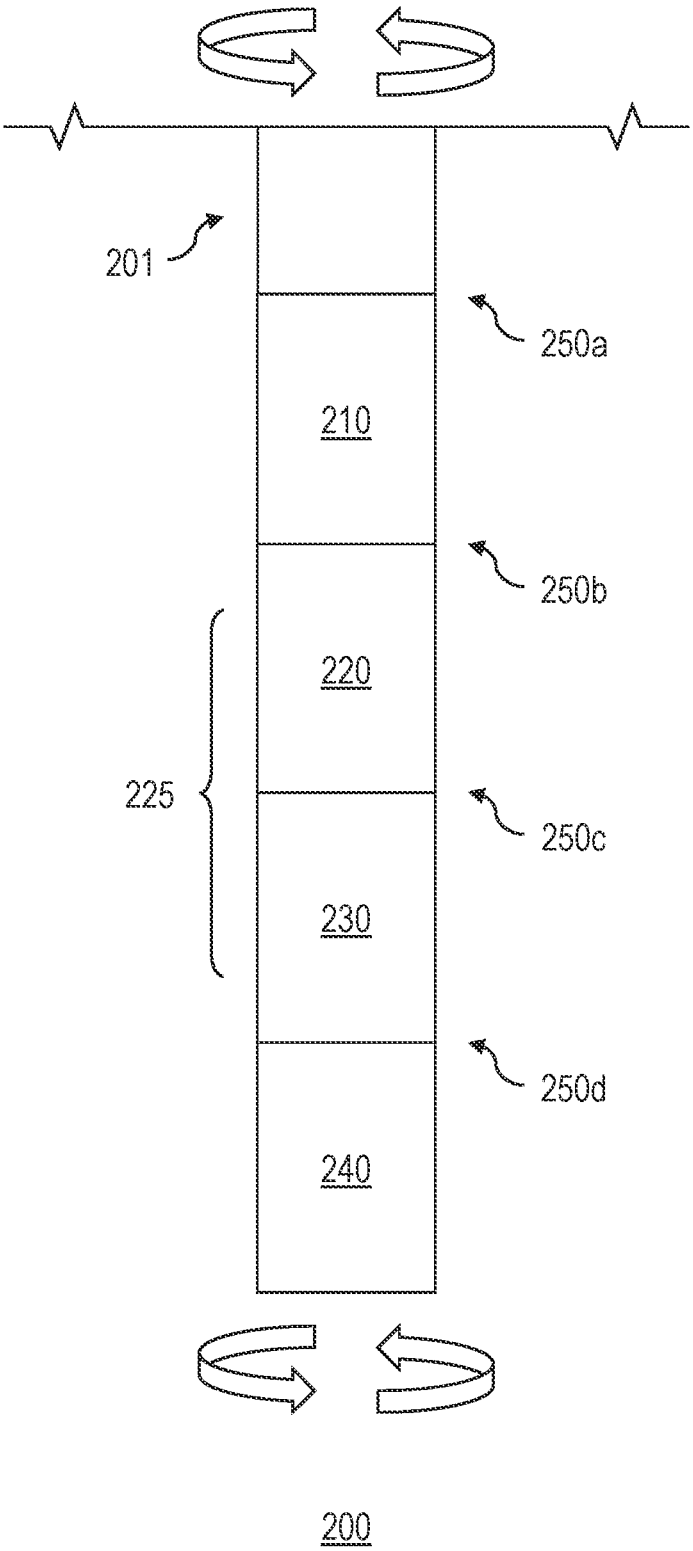
FIG. 2A is a schematic diagram of an example apparatus for removing and collecting wellbore scale and debris from the well of FIG. 1.

FIG. 2A is a schematic diagram of an example apparatus 200. The apparatus 200 can, for example, be used to remove and collect wellbore scale and/or debris from the well 100. The apparatus 200 includes a scale removal head 210, a scale collector 220, a circulating plate assembly 230, and a guide 240. The apparatus 200 can be deployed in the well 100, for example, via coiled tubing or drill pipe. In implementations in which the apparatus 200 is deployed via coiled tubing, the apparatus 200 can be rotated by a thru-tubing motor. In implementations in which the apparatus 200 is deployed via drill pipe 201, the apparatus 200 can rotate with the drill pipe 201. The apparatus 200 rotates as it travels downhole into the well 100. The guide 240 can facilitate centralizing the apparatus 200 as it travels downhole into the well 100. The guide 240 can include blades that scrape against a wall of the wellbore to remove scale and/or debris as the apparatus 200 rotates and travels downhole. The scale removal head 210 can include blades that scrape against the wall of the wellbore to remove scale and/or debris as the apparatus 200 rotates and travels downhole. The scale collector 220 and circulating plate assembly 230 can define a collection volume for storing the scale and/or debris that has been removed from the wall of the wellbore (for example, by the scale removal head 210, by the guide 240, or by both). The scale collector 220 and circulating plate assembly 230 can include slots and/or perforations that allow fluid to pass through the scale collector 220 and circulating plate assembly. Once deployed (run in hole (RIH)) to a desired depth, the apparatus 200 can be retrieved (for example, pulled out of hole (POOH)). In some implementations, the apparatus 200 is rotated while it is being POOH to remove scale and/or debris, for example, that may not have been removed while it was being RIH. Once the apparatus 200 has been retrieved at the surface, the collected scale and/or debris can be removed from the collection volume of the apparatus 200 and can be analyzed. The scale and/or debris can, for example, be analyzed to determine one or more characteristics about the well 100.

The scale removal head 210 can be coupled to the drill pipe 201. The scale collector 220 can be coupled to the scale removal head 210 opposite of the drill pipe 201. The circulating plate assembly 230 can be coupled to the scale collector 220 opposite of the scale removal head 210. The guide 240 can be coupled to the circulating plate assembly 230 opposite of the scale collector 220. The scale removal head 210 can be coupled to the drill pipe 201 by a first threaded connection 250*a*. The scale collector 220 can be coupled to the scale removal head 210 by a second threaded connection 250*b*. The circulating plate assembly 230 can be coupled to the scale collector 220 by a third threaded connection 250*c*. The guide 240 can be coupled to the circulating plate assembly 230 by a fourth threaded connection 250*d*.

Figure 2B:
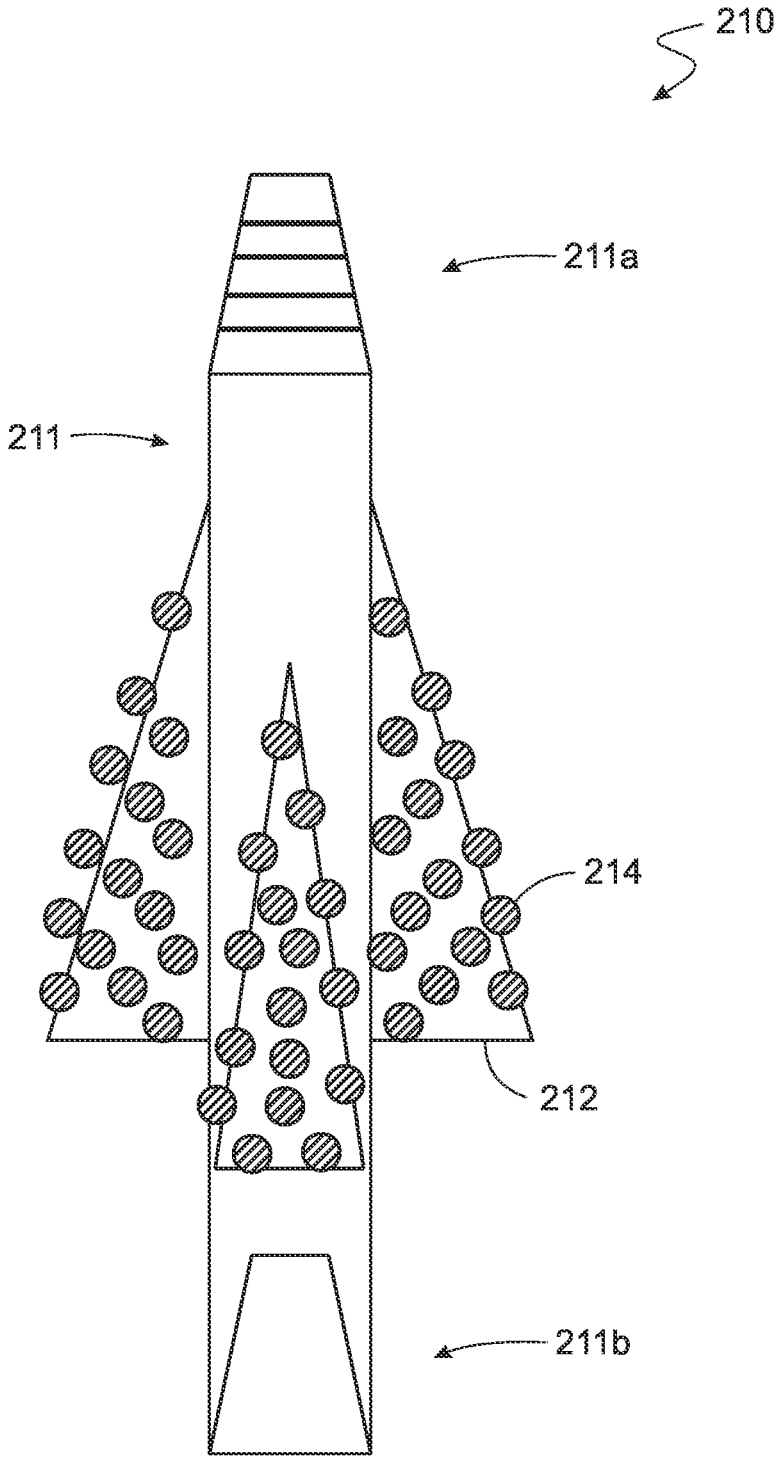
FIG. 2B is a schematic diagram of an example scale removal head of the apparatus of FIG. 2A.

FIG. 2B is a schematic diagram of an example scale removal head 210 of the apparatus 200. The scale removal head 210 is configured to couple to a drill pipe (such as the drill pipe 201) or a thru-tubing motor that is coupled to a coiled tubing. Once coupled to the scale removal head 210, the drill pipe 201 or the thru-tubing motor can rotate the apparatus 200. For example, the apparatus 200 can rotate with the drill pipe 201 via the coupling between the scale removal head 210 and the drill pipe 201. For example, the apparatus 200 can be rotated by the thru-tubing motor via the coupling between the scale removal head 210 and the thru-tubing motor. The scale removal head 210 includes blades 212 that are distributed around and extend radially outward from a surface of the scale removal head 210. In some implementations, as shown in FIG. 2B, the scale removal head 210 includes a rod 211 around which the blades 212 are distributed and from which the blades 212 extend radially outward. The blades 212 are configured to scrape against a wall of a wellbore (for example, a tubular installed in the well 100) as the apparatus 200 rotates to remove scale and/or debris from the wall of the wellbore. In some implementations, as shown in FIG. 2B, each of the blades 212 include inserts 214 that are disposed on surfaces of the blades 212. The inserts 214 can facilitate removal of scale and/or debris as the blades 212 scrape against the wall of the wellbore. For example, the blades 212 and the inserts 214 can be cooperatively configured to scrape against the wall of the wellbore to remove scale and/or debris from the wall of the wellbore in response to rotation of the apparatus 200. In some implementations, the rod 211 includes threaded ends 211*a*, 211*b*. The rod 211 can be coupled to the drill pipe 201 or thru-tubing motor via a threaded connection by any of the threaded ends 211*a*, 211*b*. For example, the threaded end 211*a* of the scale removal head 210 can be coupled to the drill pipe 201 or the thru-tubing motor to form the threaded connection 250*a*.

Figure 2C:
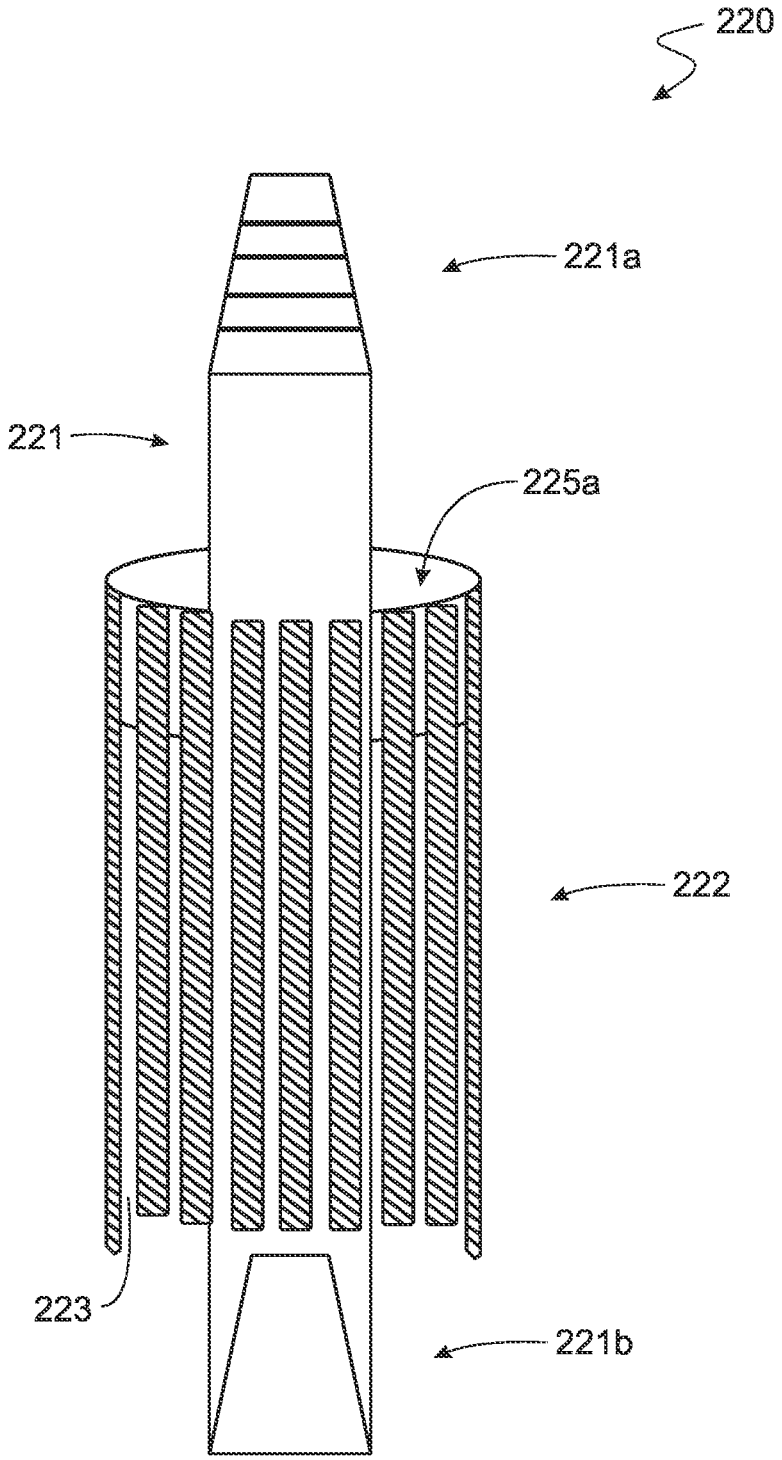
FIG. 2C is a schematic diagram of an example scale collector of the apparatus of FIG. 2A.

FIG. 2C is a schematic diagram of an example scale collector 220 of the apparatus 200. The scale collector 220 is configured to couple to the scale removal head 210. Once coupled to the scale removal head 210, the scale collector 220 can rotate with the scale removal head 210. The scale collector 220 includes a slotted chamber 222. In some implementations, as shown in FIG. 2C, the scale collector 220 includes a rod 221, and the slotted chamber 222 surrounds (for example, encompasses) the rod 221. The scale collector 220 defines a first inner region 225*a* within the slotted chamber 222. In some implementations, the first inner region 225*a* is defined as the annulus between the rod 221 and the slotted chamber 222. The slotted chamber 222 defines slots 223 through which fluid can pass through the slotted chamber 222. The slots 223 can be sized to prevent scale and/or debris of a certain size (or larger) cannot pass through the slots 223. In some implementations, the slots 223 are at least about 1 millimeter (mm) wide, at least about 2 mm wide, or at least about 3 mm wide. For example, the slots 223 are in a range of from about 1 mm to about 5 mm, from about 2 mm to about 4 mm, or about 2 mm to about 3 mm. In some implementations, the rod 221 includes threaded ends 221*a*, 221*b*. The rod 221 can be coupled to the rod 211 of the scale removal head 210 via a threaded connection by any of the threaded ends 221*a*, 221*b*. For example, the threaded end 221*a* of the scale collector 220 can be coupled to the threaded end 211*b* of the scale removal head 210 to form the threaded connection 250*b*.

Figure 2D:
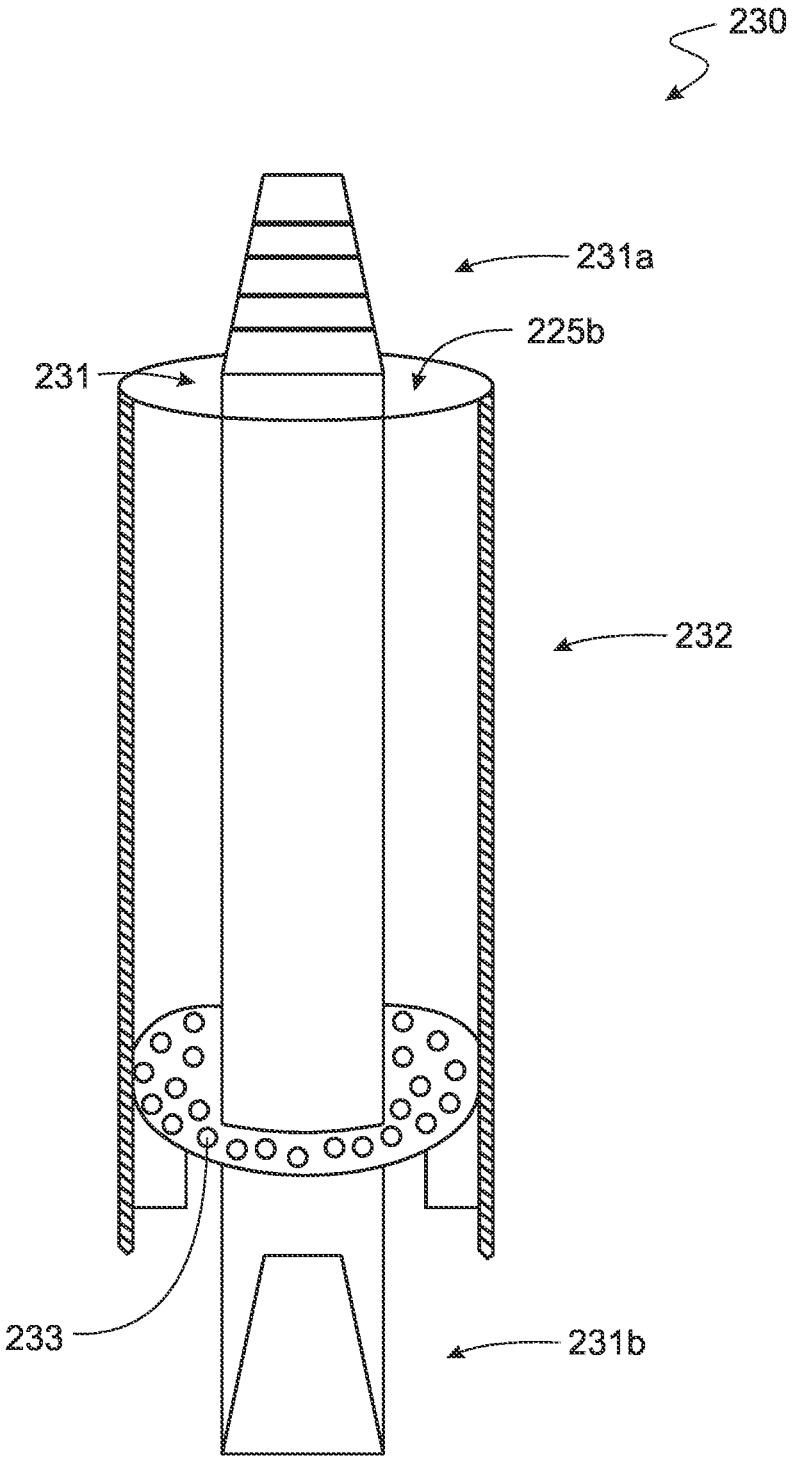
FIG. 2D is a schematic diagram of an example circulating plate assembly of the apparatus of FIG. 2A.

FIG. 2D is a schematic diagram of an example circulating plate assembly 230 of the apparatus 200. The circulating plate assembly 230 is configured to couple to the scale collector 220. Once coupled to the scale collector 220, the circulating plate assembly 230 can rotate with the scale collector 220. The circulating plate assembly 230 includes a pipe 232. The pipe 232 includes an open end 232*a* and a perforated end 232*b*. The perforated end 232*b* is opposite the open end 232*a*. The perforated end 232*b* defines perforations 233 through which fluid can pass through the pipe 232. The perforations 233 can be sized to prevent scale and/or debris of a certain size (or larger) cannot pass through the perforations 233. In some implementations, the perforations 233 have diameters that are at least about 1 mm, at least about 2 mm, or at least about 3 mm. For example, the perforations 233 have diameters that are in a range of from about 1 mm to about 5 mm, from about 2 mm to about 4 mm, or about 2 mm to about 3 mm. In some implementations, as shown in FIG. 2D, the circulating plate assembly 230 includes a rod 231, and the pipe surrounds the rod 231. The circulating plate assembly 230 defines a second inner region 225*b* within the pipe 232. In some implementations, the second inner region 225*b* is defined as the annulus between the rod 231 and the pipe 232. The first inner region 225*a* (defined by the scale collector 220) and the second inner region 225*b* (defined by the circulating plate assembly 230) together define a collection volume 225 for accumulating and storing scale and/or debris that has been removed from the wall of the wellbore. In some implementations, the rod 231 includes threaded ends 232*a*, 232*b*. The rod 231 can be coupled to the rod 221 of the scale collector 220 via a threaded connection by any of the threaded ends 231*a*, 231*b*. For example, the threaded end 231*a* of the circulating plate assembly 230 can be coupled to the threaded end 221*b* of the scale collector 220 to form the threaded connection 250*c*. In some implementations, the open end 232*a* of the pipe 232 is configured to couple to the slotted chamber 222 of the scale collector 220 that is coupled to the circulating plate assembly 230.

Figure 2E:
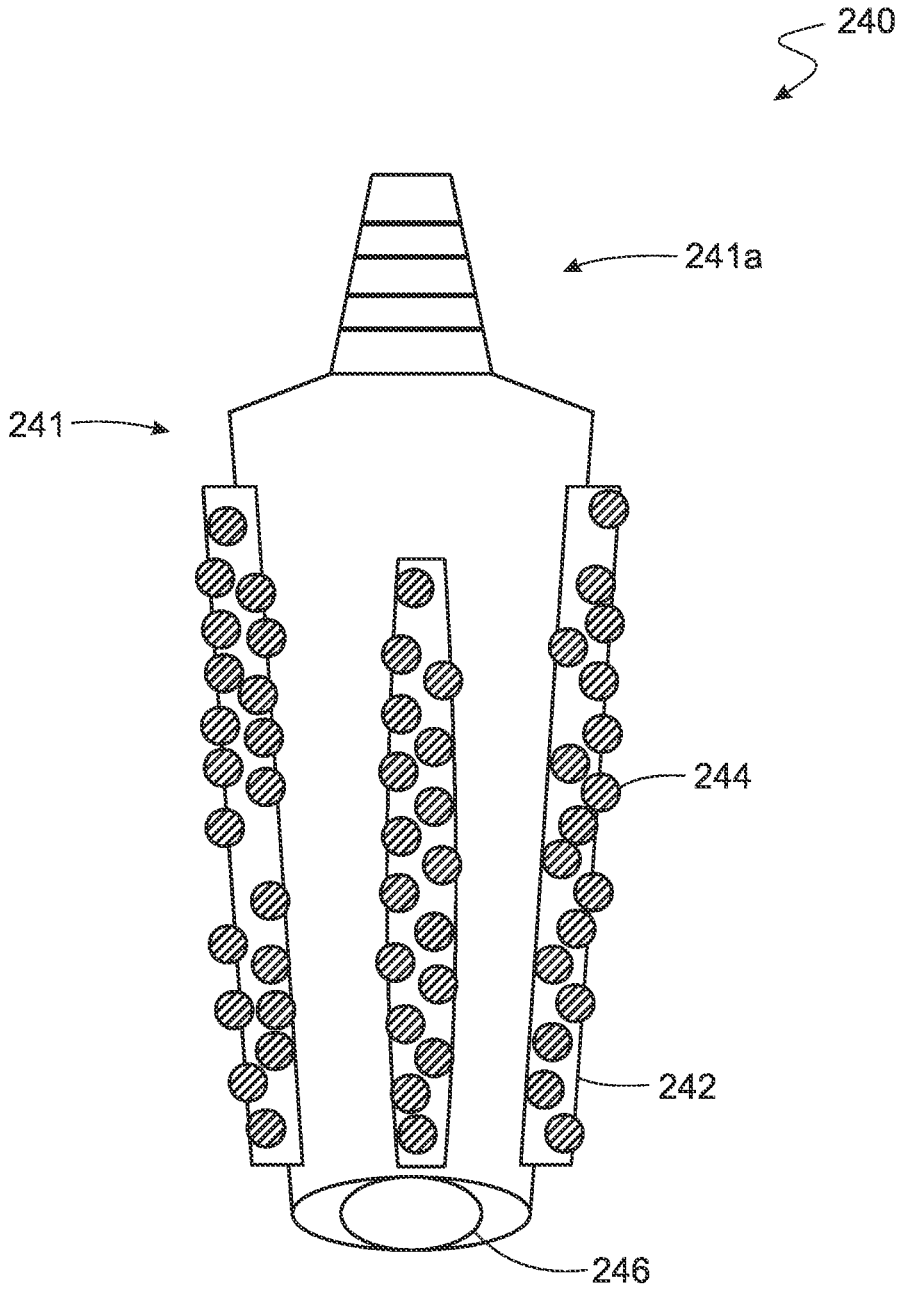
FIG. 2E is a schematic diagram of an example guide of the apparatus of FIG. 2A.

FIG. 2E is a schematic diagram of an example guide 240 of the apparatus 200. The guide 240 is configured to couple to the circulating plate assembly 230. Once coupled to the circulating plate assembly 230, the guide 240 can rotate with the circulating plate assembly 230. The guide 240 includes blades 242 that are distributed around and extend radially outward from a surface of the guide 240. In some implementations, as shown in FIG. 2E, the guide 240 includes a body 241 around which the blades 242 are distributed and from which the blades 242 extend radially outward. The body 241 can, for example, be shaped to facilitate the centralizing function of the guide 240. For example, the body 241 can be shaped similarly to an ellipsoid, which may better facilitate the centralizing function of the guide 240 in comparison to a rod. The blades 242 are configured to scrape against the wall of the wellbore as the apparatus 200 rotates to remove scale and/or debris from the wall of the wellbore. In some implementations, as shown in FIG. 2E, each of the blades 242 include inserts 244 that are disposed on surfaces of the blades 242. The inserts 244 can facilitate removal of scale and/or debris as the blades 242 scrape against the wall of the wellbore. For example, the blades 242 and the inserts 244 can be cooperatively configured to scrape against the wall of the wellbore to remove scale and/or debris from the wall of the wellbore in response to rotation of the apparatus 200. Thus, both the scale removal head 210 and the guide 240 can work together to remove scale and/or debris from the wall of the wellbore. For example, the guide 240 may remove scale and/or debris from the wall of the wellbore that the scale removal head 210 might have missed. For example, the scale removal head 210 may remove scale and/or debris from the wall of the wellbore that the guide 240 might have missed. In some implementations, the rod 241 includes a threaded end 241. The rod 241 can be coupled to the circulating plate assembly 230 via a threaded connection by the threaded end 241*a*. For example, the threaded end 241*a* of the guide 240 can be coupled to the threaded end 231*b* of the circulating plate assembly 230 to form the threaded connection 250*d*.

The guide 240 can include a jet nozzle 246. In some implementations, the jet nozzle 246 is opposite the threaded end 241*a*. The jet nozzle 246 can be configured to circulate fluid (such as a drilling fluid) through the wellbore. Circulating fluid through the wellbore by the jet nozzle 246 can facilitate travel of the apparatus 200 through the wellbore. Circulating fluid through the wellbore by the jet nozzle 246 can facilitate removal of scale and/or debris from the wall of the wellbore as the apparatus 200 rotates and travels through the wellbore.

In some implementations, the blades 242 of the guide 240 are substantially the same as the blades 212 of the scale removal head 210. In some implementations, the blades 242 of the guide 240 are different from the blades 212 of the scale removal head 210. In some implementations, the inserts 244 of the guide 240 are substantially the same as the inserts 214 of the scale removal head 210. In some implementations, the inserts 244 of the guide 240 are different from the inserts 214 of the scale removal head 210.

Figure 3:
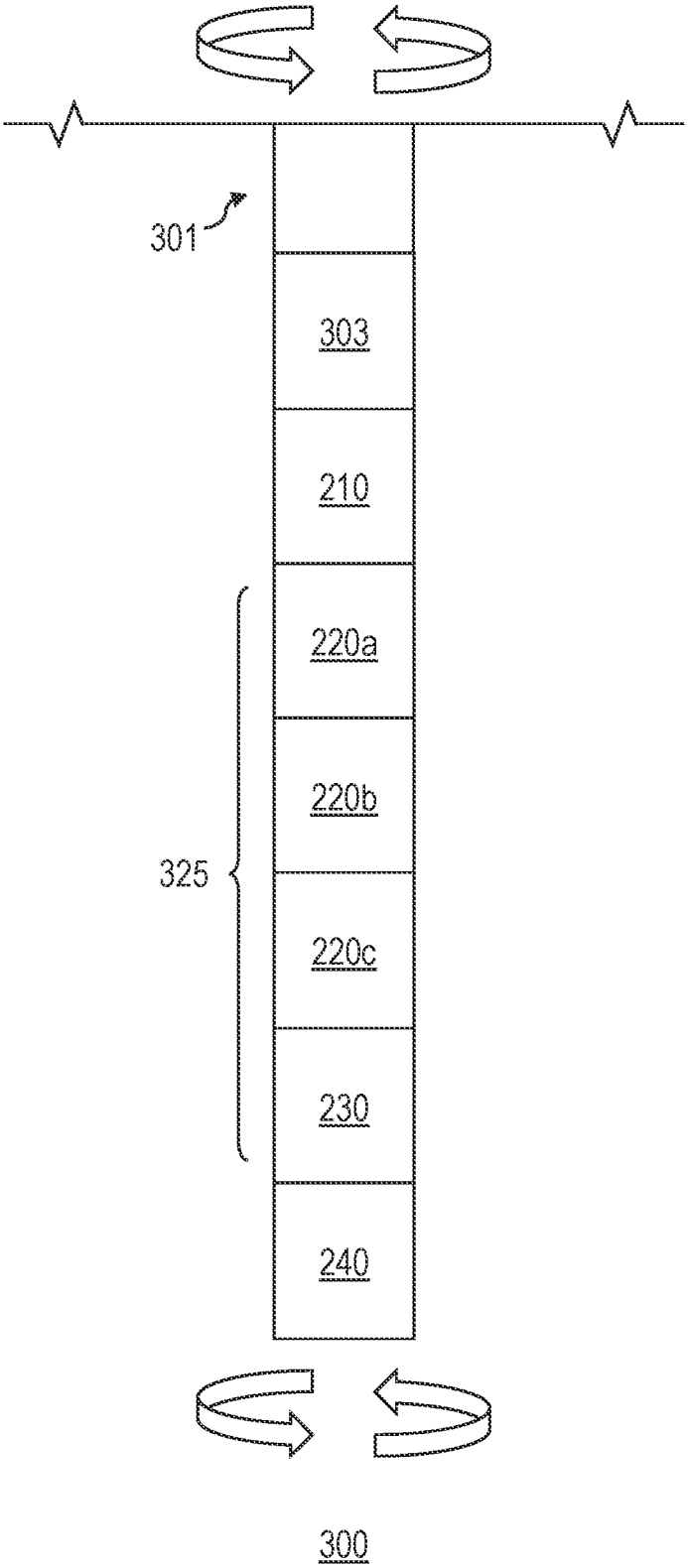
FIG. 3 is a schematic diagram of an example apparatus for removing and collecting wellbore scale and debris.

FIG. 3 is a schematic diagram of an example apparatus 300. The apparatus 300 can be substantially similar to the apparatus 200 and can include the same or substantially similar components of the apparatus 200 (such as the scale removal head 210, the scale collector 220, the circulating plate assembly 230, and the guide 240). The apparatus 300 can, for example, be used to remove and collect wellbore scale and debris from the well 100. The apparatus 300 can be coupled to a thru-tubing motor 303 that is coupled to a coiled tubing 301. For example, the scale removal head 210 is coupled to the thru-tubing motor 303. The thru-tubing motor 303 can be configured to rotate the apparatus 300.

In some implementations, as shown in FIG. 3, the apparatus 300 includes multiple scale collectors 220. Including multiple scale collectors can be useful for removing and collecting larger amounts of scale and/or debris from the well 100. Although shown in FIG. 3 as including three scale collectors (220*a*, 220*b*, 220*c*), the apparatus 300 can include fewer scale collectors 220 (for example, one or two) or more scale collectors 220 (for example, four, five, or more than five). In some implementations, as shown in FIG. 3, the scale collectors 220 are consecutive and coupled end-to-end. In some implementations, the scale collectors 220 can be separated by a different component of the apparatus 300 (such as the scale removal head 210 or the circulating plate assembly 230). In some implementations, the apparatus 300 includes multiple implementations of any of the components of the apparatus 200 (for example, multiple scale removal heads 210, multiple scale collectors 220, multiple circulating plate assemblies 230, multiple guides 240, or any combination of these). In some implementations, the apparatus 300 includes multiple implementations of the apparatus 200. For example, the apparatus 300 can include two or more implementations of the apparatus 200 coupled end-to-end.

Figure 4:
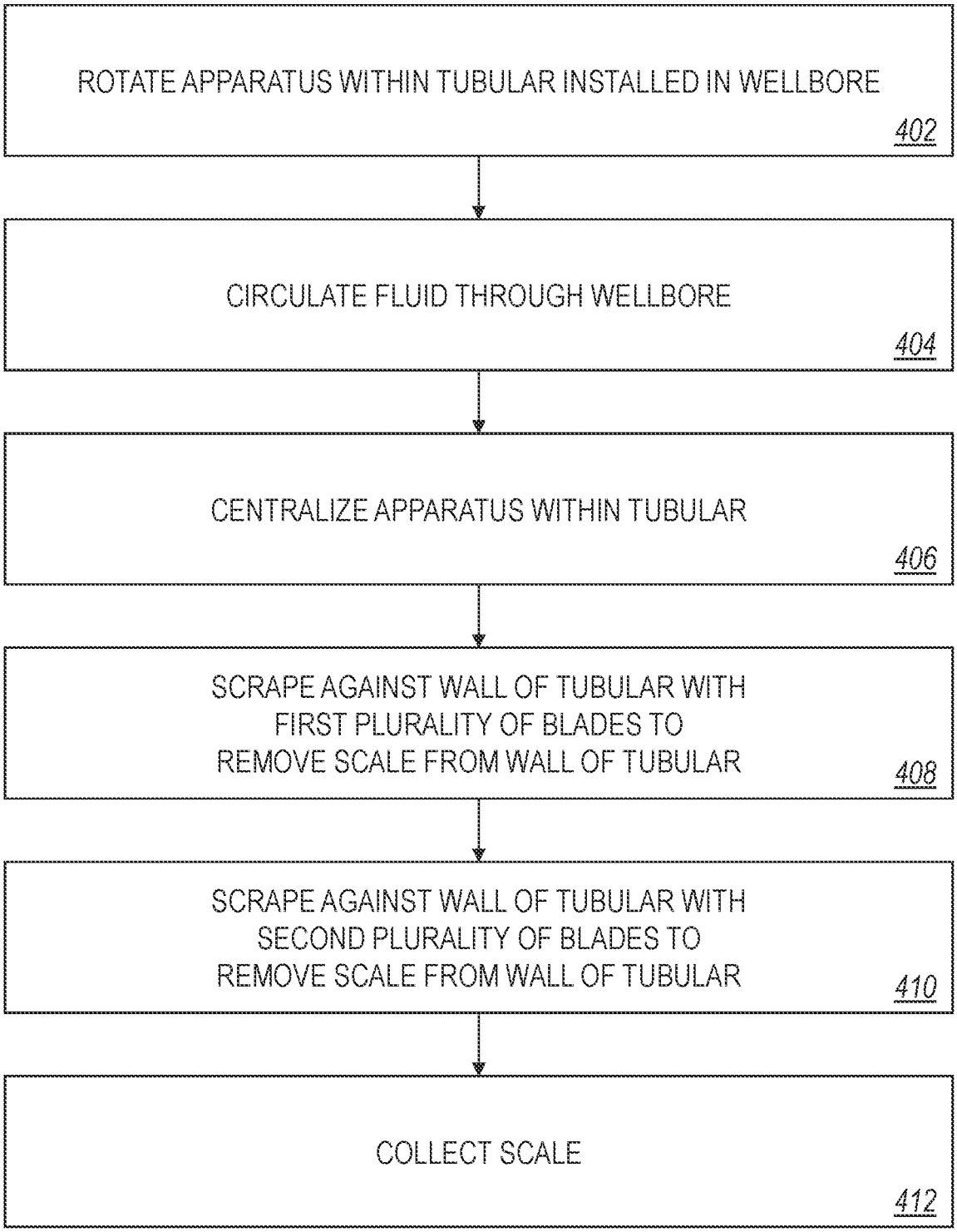
FIG. 4 is a flow chart of an example method for removing and collecting wellbore scale and debris.

FIG. 4 is a flow chart of an example method 400 for removing and collecting wellbore scale and debris, for example, from the well 100. Any of the apparatuses 200 or 300 can, for example, implement method 400. For simplicity and clarity, the description of the method 400 in this paragraph is described in relation to apparatus 200 (although apparatus 300 can optionally be used instead). At block 402, the apparatus 200 is rotated. The apparatus 200 being rotated at block 402 is disposed within a tubular (for example, a production tubing or the casing 112) installed in a wellbore (for example, the wellbore of the well 100). At block 404, fluid is circulated through the wellbore by a jet nozzle (such as the jet nozzle 246) of the guide 240. In response to rotating the apparatus 200 at block 402 and circulating the fluid at block 404, the apparatus 200 is centralized within the tubular by the guide 240 at block 406. Rotating the apparatus 200 at block 402 and circulating the fluid at block 404 facilitates travel of the apparatus 200 through the tubular. In response to rotating the apparatus 200 at block 402 and circulating the fluid at block 404, a first plurality of blades (such as the blades 212) of the scale removal head 210 scrapes against a wall of the tubular to remove scale and/or debris from the wall of the tubular at block 408. In response to rotating the apparatus 200 at block 402 and circulating the fluid at block 404, a second plurality of blades (such as the blades 242) of the guide 240 scrapes against the wall of the tubular to remove scale and/or debris from the wall of the tubular at block 410. At block 412, the scale and/or debris that have been removed from the wall of the tubular is collected within a collection volume (such as the collection volume 225) of the apparatus 200. As described previously, the collection volume 225 is cooperatively defined by the slotted chamber 222 of the scale collector 220 that is coupled to the pipe 232 of the circulating plate assembly 230.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. An apparatus comprising:

a scale removal head configured to couple to a drill pipe and to cause the apparatus to rotate with the drill pipe, the scale removal head comprising a first plurality of blades distributed around and extending radially outward from a surface of the scale removal head, each blade of the first plurality of blades comprising a plurality of first inserts disposed on a surface of the respective blade, wherein the first plurality of blades and their respective pluralities of first inserts are cooperatively configured to scrape against a wall of a wellbore to remove scale from the wall of the wellbore in response to rotation of the apparatus;

a scale collector configured to couple to the scale removal head and rotate with the scale removal head, the scale collector comprising a surrounding slotted chamber, the scale collector defining a first inner region within the surrounding slotted chamber;

a circulating plate assembly configured to couple to the scale collector and rotate with the scale collector, the circulating plate assembly comprising a pipe comprising an open end and a perforated end opposite the open end, the circulating plate assembly defining a second inner region within the pipe, wherein the first inner region and the second inner region together define a collection volume for accumulating and storing scale that has been removed from the wall of the wellbore, the perforated end defines a plurality of perforations through which fluid can pass through the pipe as the apparatus rotates and removes scale from the wall of the wellbore; and a guide configured to couple to the circulating plate assembly and rotate with the circulating plate assembly, the guide comprising a second plurality of blades distributed around and extending radially outward from a surface of the guide, each blade of the second plurality of blades comprising a plurality of second inserts disposed on a surface of the respective blade, wherein the second plurality of blades and their respective pluralities of second inserts are cooperatively configured to scrape against the wall of the wellbore to remove scale from the wall of the wellbore as the apparatus rotates.

2. The apparatus of claim 1, wherein the guide comprises a jet nozzle configured to circulate fluid through the wellbore, thereby facilitating travel of the apparatus through the wellbore and removal of scale from the wall of the wellbore.

3. The apparatus of claim 2, wherein:

the scale removal head is coupled to the drill pipe;

the scale collector is coupled to the scale removal head opposite of the drill pipe;

the circulating plate assembly is coupled to the scale collector opposite of the scale removal head; and the guide is coupled to the circulating plate assembly opposite of the scale collector.

4. The apparatus of claim 3, wherein the guide comprises a body around which the second plurality of blades are distributed and from which the second plurality of blades extend radially outward, wherein the blades of the second plurality of blades of the guide are smaller in comparison to the blades of the first plurality of blades of the scale removal head, and the guide is configured to, in response to the jet nozzle circulating fluid through the wellbore and the apparatus rotating, centralize the apparatus with respect to the wall of the wellbore.

5. The apparatus of claim 4, wherein the surrounding slotted chamber of the scale collector is coupled to the pipe of the circulating plate assembly, such that the surrounding slotted chamber and the pipe form an enclosure having the collection volume for accumulating and storing scale that has been removed from the wall of the wellbore.

6. The apparatus of claim 5, wherein:

the scale removal head is coupled to the drill pipe by a first threaded connection;

the scale collector is coupled to the scale removal head by a second threaded connection;

the circulating plate assembly is coupled to the scale collector by a third threaded connection; and the guide is coupled to the circulating plate assembly by a fourth threaded connection.

7. The apparatus of claim 6, wherein the surrounding slotted chamber defines a plurality of slots, and each slot of the plurality of slots has a width in a range of from about 2 millimeters to about 5 millimeters.

8. The apparatus of claim 7, wherein the perforated end of the pipe of the circulating plate assembly defines a plurality of perforations, and each perforation of the plurality of perforations has a diameter in a range of from about 2 millimeters to about 5 millimeters.

9. A method comprising:

rotating an apparatus disposed within a tubular installed in a wellbore, wherein the apparatus comprises a scale removal head, a scale collector, a circulating plate assembly, and a guide, wherein the scale collector comprises a surrounding slotted chamber and defines a first inner region, wherein the circulating plate assembly comprises a pipe comprising an open end and a perforated end opposite the open end, wherein the circulating plate assembly defines a second inner region, wherein the first inner region and the second inner region together define a collection volume, wherein the perforated end defines a plurality of perforations;

circulating fluid, by a jet nozzle of the guide, through the wellbore, thereby facilitating travel of the apparatus through the tubular;

allowing, by the perforations of the circulating plate assembly, the fluid to flow through pipe of the circulating plate assembly as the apparatus is rotated;

in response to rotating the apparatus and circulating fluid, centralizing the apparatus within the tubular;

in response to rotating the apparatus, scraping against a wall of the tubular with a first plurality of blades of the scale removal head to remove scale from the wall of the tubular, wherein the first plurality of blades are distributed around and extend radially outward from a surface of the scale removal head;

in response to rotating the apparatus, scraping against the wall of the tubular with a second plurality of blades of the guide to remove scale from the wall of the tubular, wherein the second plurality of blades are distributed around and extend radially outward from a surface of the guide; and collecting within the collection volume of the apparatus the scale that has been removed from the wall of the tubular.

10. The method of claim 9, wherein:

the scale removal head and the guide are located at opposite ends of the apparatus;

each blade of the first plurality of blades comprises a plurality of first inserts disposed on a surface of the respective blade, and the first plurality of blades and their respective pluralities of first inserts scrape, in response to rotating the apparatus, against the wall of the tubular to remove scale from the wall of the tubular; and each blade of the second plurality of blades comprises a plurality of second inserts disposed on a surface of the respective blade, and the second plurality of blades and their respective pluralities of second inserts scrape, in response to rotating the apparatus, against the wall of the tubular to remove scale from the wall of the tubular.

11. The method of claim 10, wherein the scale collector comprises a surrounding slotted chamber;

the surrounding slotted chamber of the scale collector is coupled to the pipe of the circulating plate assembly.

12. The method of claim 11, wherein the apparatus is coupled to and rotated by a thru-tubing motor.

13. The method of claim 11, wherein the apparatus is coupled to and rotated by a drill pipe.

14. The method of claim 13, wherein:

the scale removal head is coupled to the drill pipe by a first threaded connection;

the scale collector is coupled to the scale removal head opposite of the drill pipe by a second threaded connection;

the circulating plate assembly is coupled to the scale collector opposite of the scale removal head by a third threaded connection; and the guide is coupled to the circulating plate assembly opposite of the scale collector by a fourth threaded connection.

15. The method of claim 14, wherein the surrounding slotted chamber defines a plurality of slots, and each slot of the plurality of slots has a width in a range of from about 2 millimeters to about 5 millimeters.

16. The method of claim 15, wherein the perforated end of the pipe of the circulating plate assembly defines a plurality of perforations, and each perforation of the plurality of perforations has a diameter in a range of from about 2 millimeters to about 5 millimeters.

17. A system comprising:

a coiled tubing;

a thru-tubing motor coupled to the coiled tubing; and an apparatus coupled to the thru-tubing motor and disposed within a wellbore, the apparatus comprising:

a scale removal head coupled to the thru-tubing motor, wherein the thru-tubing motor is configured to rotate the apparatus, the scale removal head comprising a first plurality of blades distributed around and extending radially outward from a surface of the scale removal head, each blade of the first plurality of blades comprising a plurality of first inserts disposed on a surface of the respective blade, wherein the first plurality of blades and their respective pluralities of first inserts are cooperatively configured to scrape against a wall of the wellbore to remove scale from the wall of the wellbore as the apparatus rotates;

a scale collector coupled to the scale removal head opposite of the thru-tubing motor and configured to rotate with the scale removal head, the scale collector comprising a surrounding slotted chamber, the scale collector defining a first inner region within the surrounding slotted chamber;

a circulating plate assembly coupled to the scale collector opposite of the scale removal head and configured to rotate with the scale collector, the circulating plate assembly comprising a pipe comprising an open end and a perforated end opposite the open end, the circulating plate assembly defining a second inner region within the pipe, wherein the first inner region and the second inner region together define a collection volume for accumulating and storing scale that has been removed from the wall of the wellbore, the perforated end defining a plurality of perforations through which fluid can pass through the pipe as the apparatus rotates and removes scale from the wall of the wellbore; and a guide coupled to the circulating plate assembly opposite of the scale collector and configured to rotate with the circulating plate assembly, the guide comprising a second plurality of blades distributed around and extending radially outward from a surface of the guide, each blade of the second plurality of blades comprising a plurality of second inserts disposed on a surface of the respective blade, wherein the second plurality of blades and their respective pluralities of second inserts are cooperatively configured to scrape against the wall of the wellbore to remove scale from the wall of the wellbore as the apparatus rotates.

18. The system of claim 17, wherein the guide comprises a jet nozzle configured to circulate fluid through the wellbore, thereby facilitating travel of the apparatus through the wellbore and removal of scale from the wall of the wellbore.

19. The system of claim 18, wherein the surrounding slotted chamber of the scale collector is coupled to the pipe of the circulating plate assembly, such that the surrounding slotted chamber and the pipe form an enclosure having the collection volume for accumulating and storing scale that has been removed from the wall of the wellbore.

20. The system of claim 19, wherein:

the surrounding slotted chamber defines a plurality of slots, and each slot of the plurality of slots has a width in a range of from about 2 millimeters to about 5 millimeters; and the perforated end of the pipe of the circulating plate assembly defines a plurality of perforations, and each perforation of the plurality of perforations has a diameter in a range of from about 2 millimeters to about 5 millimeters.

* * * * *